United States Patent [19]

Cote

[11] 4,055,012

[45] Oct. 25, 1977

[54] CARD APPARATUS

[76] Inventor: Donald F. Cote, 6 Hoover Road, Hingham, Mass. 02043

[21] Appl. No.: 721,183

[22] Filed: Sept. 8, 1976

[51] Int. Cl.[2] ..... G09F 7/00

[52] U.S. Cl. ..... 40/129 C; 40/64 R

[58] Field of Search ..... 40/10 R, 10 D, 10 A, 40/64, 129 C

[56] References Cited

U.S. PATENT DOCUMENTS

| | | | |
|---|---|---|---|
| 1,068,621 | 7/1913 | Abraham | 40/64 R |
| 2,093,598 | 9/1937 | Clark | 40/10 A |
| 2,839,857 | 6/1958 | Teller | 40/152 |
| 3,139,611 | 6/1964 | Fleming | 40/67 X |
| 3,533,178 | 10/1970 | Strohmaier | 40/129 C X |

*Primary Examiner*—Louis G. Mancene
*Assistant Examiner*—Wenceslao J. Contreras
*Attorney, Agent, or Firm*—Robert D. Farkas

[57] ABSTRACT

This disclosure pertains to a housing, fabricated from a transparent material, containing a plurality of signs bearing safety warning and greeting indicia on the faces thereof, adapted to be carried in a motor vehicle. An opening in the housing permits the selective repositioning or the slidable removal of the signs, utilizing tabs or finger-grip extensions affixed to a marginal edge of the signs. The signs may be selectively removed from the housing for display by manually holding the sign or displayed within the housing through a transparent surface thereof. The housing may be adapted with double sided adhesive tape secured to one lateral surface thereof, permitting thereby fastening the housing to a convenient interior surface of the vehicle such as a window visor, glove compartment cove, door panel, dashboard, or the like.

8 Claims, 5 Drawing Figures

CARD APPARATUS

BACKGROUND OF THE INVENTION

1. The Field of the Invention

This invention relates to display signs and more particularly to that class stored within a housing adapted to be carried in motor vehicles.

2. Description of the Prior Art

The prior art abounds with motor vehicle display apparatus. U.S. Pat. No. 3,797,151 issued on Mar. 19, 1974 to H. B. Dexter teaches a motorist's emergency warning apparatus adapted to be normally stored away in a box which may be employed as the hereinafter-referred-to supporting base means for one aspect of the invention and with the device comprising an effectively collapsible, support standard means and base means adapted to be effectively moved between a collapsed or unassembled, unsupported, and non-displaying relationship and an effectively assembled, supported, and displaying relationship. The support standard means includes a plurality of relatively movable frame means portions provided with engageable and disengageable connection means for connecting the frame means and the base means in the assembled, supported, and displaying relationship when desired and for effectively disassembling and/or collapsing the apparatus for ready storage in the box when it is not to be used. The frame means is provided with visibly perceptible, display panel means carried thereacross and defining a display panel of a substantial area positionable in the line of sight of an oncoming motorist and provided with information-bearing display material indicating an emergency condition of an associated motor vehicle and, in certain forms of the invention, indicating the exact nature of said emergency condition.

U.S. Pat. No. 3,772,811 issued on Nov. 20, 1973 to R. E. Alsup discloses a stranded motorists' distress sign for use by motorists stranded on the interstate highway system. The sign comprises a board carrying a visible distress legend which is supported by a base member. A magnetized mounting means is utilized for mounting the sign to the metallic top of an automotive vehicle, so as to be visible to passing motorists, who can send help to the location.

Both of the aforementioned patents suffer the common deficiencies of failing to provide for a large number of inexpensive signs stored within a carrier-like housing within the motor vehicle, enabling the motorist to display a selected sign without stopping the motor vehicle.

SUMMARY OF THE INVENTION

A primary object of the present invention is to provide a housing which compactly stores a plurality of card-like signs.

Another object is to provide a housing which permits the signs stored therewithin to be manually slidably withdrawn therefrom.

Still another object is to provide an index type tab on each of the aforementioned signs facilitating their correct selection and convenient rapid sliding withdrawal from within the housing.

Yet another object is to provide a transparent housing which enables at least one side of one sign to be directly viewed therethrough.

A hollow rectangular tube, fabricated from a transparent material, contains a plurality of rectangular board-like signs housed therewithin. Thus, maximum utility of space is provided since each sign may bear an individual message on each lateral face thereof. The signs may be withdrawn, by sliding them outwardly from within the hollow rectangular tube, by grasping a tab projecting outwardly from the tube affixed to the sign. The tab may bear indicia identifying the words or symbols on the sign. Alternatively, a handle-like projection may be carried by each sign facilitating the display of a manually held sign. Mounting means are provided so as to conveniently store the sign carrying rectangular tube within a motor vehicle. The signs may be viewed through one of the transparent surfaces of the transparent tube, without removal therefrom, if so desired.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a hollow rectangular housing fabricated from a transparent material such as polymethylmethacrylate, having at least one end thereof open, through which a plurality of rectangular board-like signs may be introduced into and slidably withdrawn from the interior of the housing. Two extended lengths of parallelally disposed strips of double faced adhesive material are secured to one lateral surface of the housing adjacent the opposed extended marginal edges thereof. Each card is adapted with indicia on each of the lateral surfaces thereof and equipped with a tab-like extension adapted to reside outwardly of the housing when the major portion of the card is stored therewithin. The extension may be corrugated and be thicker than the remainder of the sign so as to facilitate convenient manual grasping by the fingers of the user. Additionally, each tab may be labelled to correspond with the indicia carried by each sign, facilitating the manual selection thereof. The signs are adapted to carry messages of a warning variety such as soft tire, door ajar, lights on, something dragging, turn signals on, or greetings to adjacent motorists such as have a nice day, thank you, may I cut in, I'll summon aid, and the like.

Figure 1:
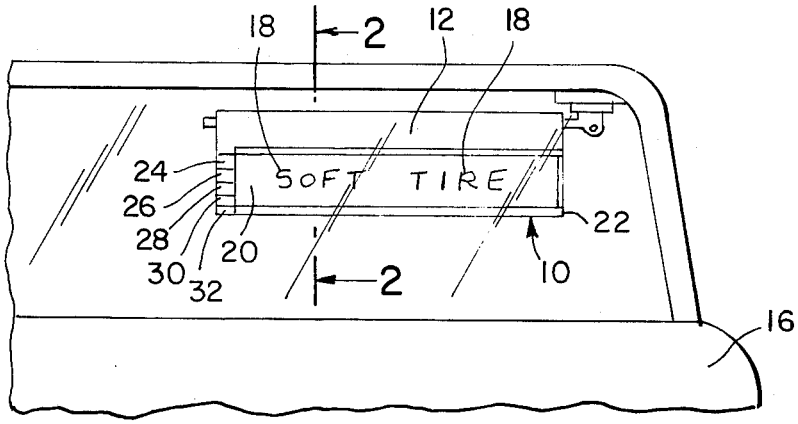
FIG. 1 is a front elevation view of the present invention shown mounted in a portion of a motor vehicle.

Now referring to the Figures, and more particularly to the embodiment illustrated in FIG. 1 showing the present invention 10 being mounted to a sun visor 12 as viewed through a front windshield of a motor vehicle 16. Indicia 18, bearing the legend "Soft Tire," is carried by a card 20 contained within the transparent housing 22 and carrying a tab 24 extending outwardly from the housing. Tabs 26, 28, 30, and 32 are affixed to other cards, not shown, stored behind card 20 in housing 22.

Figure 2:
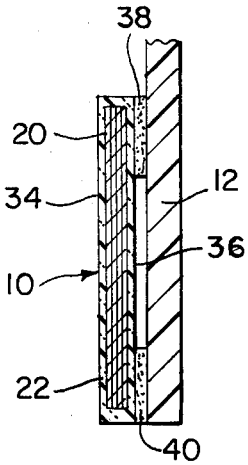
FIG. 2 is a side elevation cross-sectional view taken along line 2—2 viewed in the direction of arrows 2—2 as shown in FIG. 1.

FIG. 2 shows housing 22 in cross-section having opposed spaced apart transparent lateral surfaces 34 and 36. The indicia, not shown, carried by card 20 may be viewed through surface 34. Strips 38 and 40, of a two-sided adhesive tape, fixes surface 36 of housing 22 to visor 12.

Figure 3:
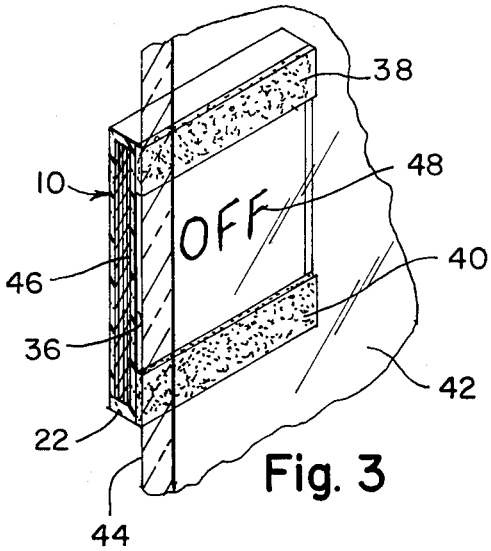
FIG. 3 is a perspective view of the present invention shown mounted to a portion of a window element of a motor vehicle.

FIG. 3 illustrates a glass portion 42 of a motor vehicle, such as the windshield, side windows, or rearview window of the vehicle. Adhesive strips 38 and 40 fasten housing 22 to the interior surface 44 of window 42. Card 46 bearing indicia 48, denoting the word "Off," may be seen by light passing through window 42 and surface 36 of housing 22.

Figure 4:
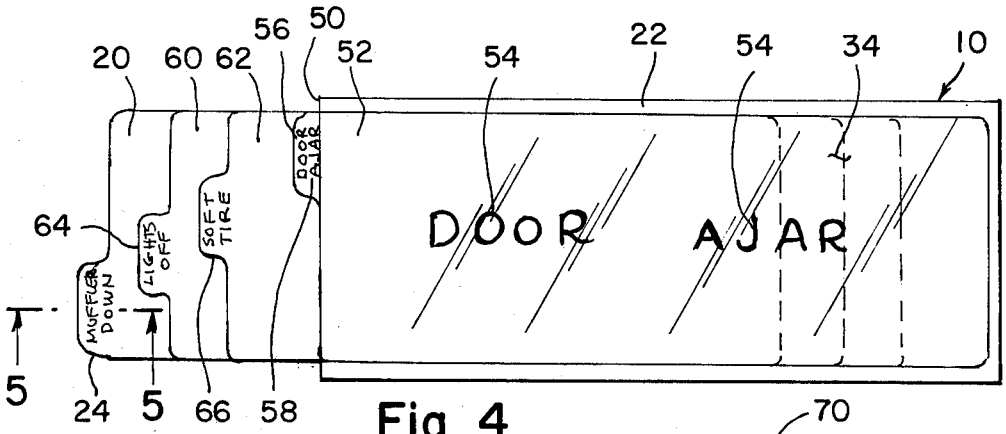
FIG. 4 is a front elevation view of the present invention illustrating some cards partially slidable withdrawn from the housing thereof.

FIG. 4 shows housing 22 having an open end portion 50. Transparent surface 34 permits card 52 to be seen bearing the indicia 54 denoting the words "Door Ajar." Tab 56 extends outwardly from opening 50 and bears indicia 58 denoting "Door Ajar" equivalent to indicia 54. Card 20 carries tab 24 whose indicia is equivalent to the indicia carried on the major lateral surface adjacent to tab 24. Card 20 is shown partially slidably withdrawn from opening 50 outwardly from housing 22. Cards 60 and 62 are also shown partially withdrawn outwardly from the housing and carrying individual identifying tabs 64 and 66.

Figure 5:
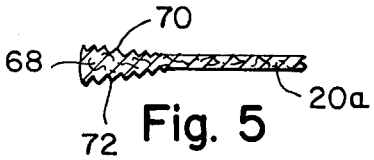
FIG. 5 is a cross-sectional view taken along line 5—5 viewed in the direction of arrows 5—5 as shown in FIG. 4.

FIG. 5 shows a portion 20*a* of card 20 as shown in FIG. 4. Thickened portion 68 is adapted with corrugated surfaces, 70 and 72 corresponding to tab 24, shown in FIG. 4. Indicia may or may not be carried by surfaces 70 and 72, as desired. The corrugations serve as a finger gripping handle for selecting and displaying the sign.

One of the advantages is a housing which compactly stores a plurality of card-like signs.

Another advantage is a housing which permits the signs stored therewithin to be manually slidably withdrawn therefrom.

Still another advantage is an index type tab on each of the aforementioned signs facilitating their correct selection and convenient rapid sliding withdrawal from within the housing.

Yet another advantage is a transparent housing which enables at least one side of one sign to be directly viewed therethrough.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A card apparatus comprising a hollow housing, the housing having a rectangular cross-section and a pair of elongated rectangular surfaces disposed in parallel spaced apart relationship to each other, the pair of elongated rectangular surfaces being fabricated from a transparent material, a rectangular opening in one end of the housing being disposed intermediate the pair of elongated rectangular surfaces, means to fixedly secure one of the pair of elongated rectangular surfaces to an interior surface of a motor vehicle, a plurality of board like rectangular signs, each of the plurality of signs being disposed in parallel relationship stored within the housing, each of the signs being slidably removable from within the housing by passing through the rectangular opening, indicia carried by each of the signs, means to individually identify each of the signs by a portion thereof extending outwardly of the housing passing through the rectangular opening, wherein said portion of said each of said signs comprises a handle-like tab whose thickness excedds the thickness of the sign to which it is affixed, the lateral surfaces of the handle-like tab having corrugations disposed therein.

2. The card apparatus as claimed in claim 1 wherein the securing means comprises a pair of elongated double sided adhesive covered strips fixedly secured in spaced apart relationship to one of the pair of elongated rectangular surfaces.

3. The card apparatus as claimed in claim 1 wherein the indicia is carried by each of lateral surfaces of each of the signs.

4. The card apparatus as claimed in claim 3 wherein the indicia are messages signifying safety signals.

5. The card apparatus as claimed in claim 3 wherein the indicia are messages signifying greetings.

6. The card apparatus as claimed in claim 1 wherein the individual identifying means comprises said tab bearing identifying indicia equivalent to said indicia.

7. The card apparatus as claimed in claim 6 wherein the handle-like tab carries identifying indicia equivalent to said indicia.

8. The card apparatus as claimed in claim 1 wherein the transparent material comprises polymethalmethacrylate.

* * * * *